United States Patent [19]

Anderson et al.

[11] Patent Number: 4,738,878

[45] Date of Patent: Apr. 19, 1988

[54] IN SITU PRESERVATIVE TREATMENT OF RAILROAD TIE

[75] Inventors: H. E. Anderson, Beloit; Steve Jandl, Marshall, both of Wis.; Michael E. Rider, Lockport, N.Y.

[73] Assignee: Osmose Wood Preserving, Inc., Madison, Wis.

[21] Appl. No.: 31,564

[22] Filed: Mar. 30, 1987

[51] Int. Cl.[4] ..... B05D 3/12; E04B 1/16; E01B 3/36; E01B 3/46

[52] U.S. Cl. ..... 427/369; 238/84; 264/31; 428/907

[58] Field of Search ..... 238/84; 264/31; 427/369; 428/907

[56] References Cited

U.S. PATENT DOCUMENTS

| | | | |
|---|---|---|---|
| 1,388,877 | 8/1921 | Moore . | |
| 2,216,775 | 10/1940 | Helson | 21/9 |
| 2,623,300 | 12/1952 | Hudson | 34/13.8 |
| 3,907,201 | 9/1975 | Dlugosz | 238/84 |
| 4,156,440 | 5/1979 | Katoh | 106/273 R |
| 4,202,494 | 5/1980 | Rumell | 264/278 X |
| 4,267,085 | 5/1981 | Katoh | 106/273 R |
| 4,449,666 | 5/1984 | Hales et al. | 238/84 |
| 4,634,545 | 1/1987 | Zaleski et al. | 427/369 X |
| 4,652,495 | 3/1987 | Sato et al. | 238/84 |

*Primary Examiner*—Michael R. Lusignan

*Attorney, Agent, or Firm*—Fulwider, Patton, Rieber, Lee & Utecht

[57] ABSTRACT

In situ wood preservative treatment of a wooden railroad tie. The method includes the steps of injecting a paste-like preparation having a water soluble fungicide into one or more unoccupied spike holes in the rail supporting tie plate. The preparation lodges in crevices and recesses in communication with the spike hole, killing existing decay fungi. Over a period of time the fungicide follows existing or subsequently developed paths of moisture to more remote decay sites.

8 Claims, 2 Drawing Sheets

FIG. 5
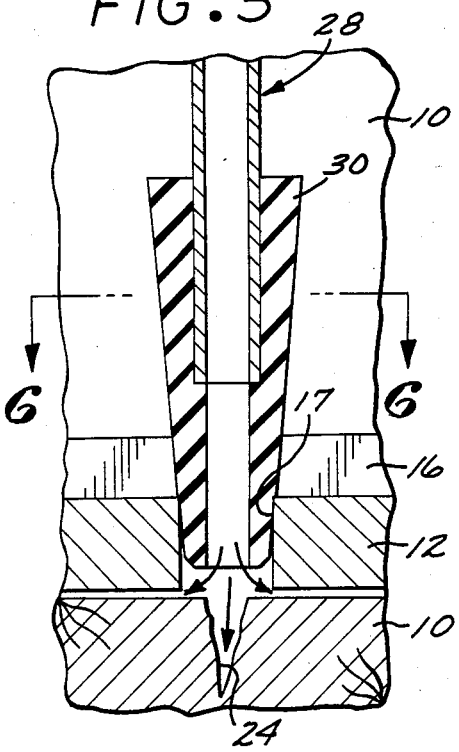
FIG. 6
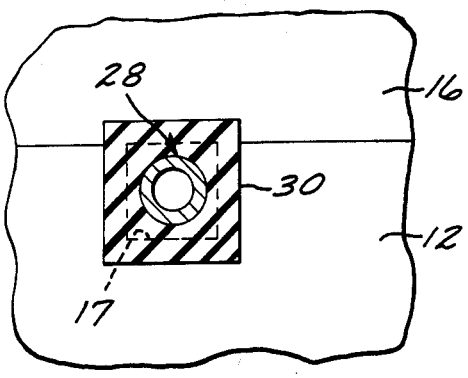
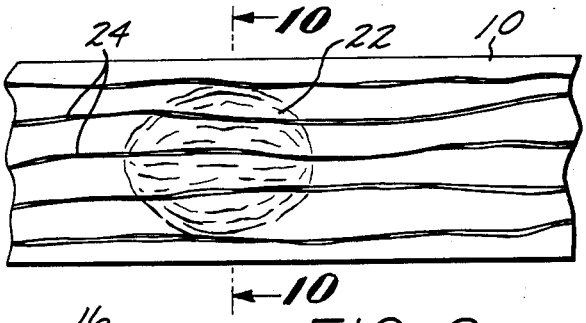
FIG. 9
FIG. 7
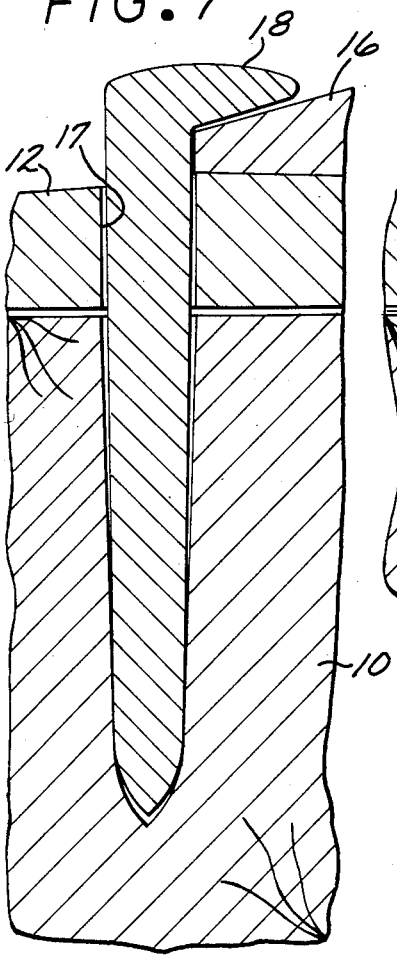
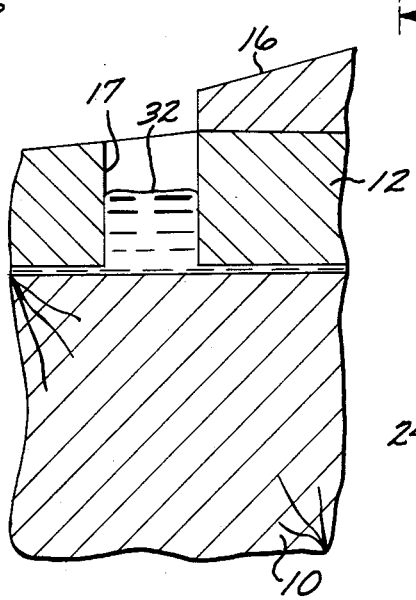
FIG. 8
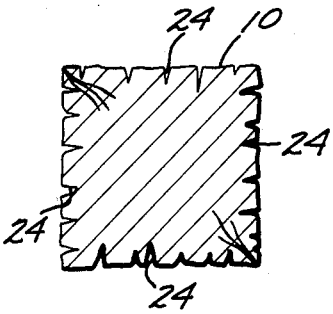
FIG. 10

IN SITU PRESERVATIVE TREATMENT OF RAILROAD TIE

BACKGROUND OF THE INVENTION

1. Field of the Invention:

The present invention relates to a method of in situ treatment of a wooden railroad tie for terminating the growth of decay fungi, particularly at the interface between the tie and the rail supporting tie plate.

2. Description of the Related Art:

Wooden railroad ties are made decay resistant by forcing a material such as creosote into the wood cell structure under relatively high pressure. This protects the exterior wood layer but the interior is not penetrated by the creosote and is subject to attack by decay fungi whenever the exterior layer is split, cracked, abraded away or otherwise structurally compromised. Penetration of the treated exterior is common after extended service use as a result of weathering and also as a result of what is known as spike kill and plate cut.

Weathering typically causes weather checking in the form of splits or cracks running in the direction of the wood grain. These cracks provide passages for moisture to travel under the tie plate supporting the rail and into the tie spike holes and checks.

Spike kill in the mechanical enlargement of spike holes caused by cyclical train loadings on the rail, spike and tie plate, the relative movement between these components eventually enlarging the spike hole and exposing untreated tie wood. This relative movement also causes plate cut, which is the wearing or cutting away of the tie at the interface between the tie plate and tie. This action tends to abrade away the treated exterior wood layer and expose the tie interior to the intrusion of moisture and wind borne fungi spores.

Soon after railroad ties are put into service moisture sites become established, particularly in the central portion of the interface between the tie and tie plate. This central portion never seems to dry. As a consequence, the presence of moisture and the temperature elevation brought on by exposure to the sun services as an incubator for the growth of decay fungi. The natural balance of food, moisture and temperature accelerates destruction of the wood cells and exaggerates spike kill and plate cut in a cycle which eventually results in premature failure and costly replacement of the ties.

Some railroad companies have attempted to skirt the decay problem altogether by using specially fabricated ties, such as concrete ties, but this has not proved to be satisfactory because of the economics. Such ties are not inherently resilient and costly measures have to be taken to compensate for this. U.S. Pat. Nos. 4,156,440 and 4,267,085, issued to Katoh et al on May 29, 1979 and May 12, 1981, respectively, disclose the use of concrete ties resting on a ballast roadbed, but requiring injection of a layer of thermoplastic material between the ties and the roadbed to disperse the stresses developed when a train passes over the rails.

Various other prior art attempts to more thoroughly protect wooden ties from fungi attack are discussed in U.S. Pat. No. 1,388,877, issued to Moore on Aug. 30, 1921. He indicates that the fungicide material in wooden ties tends to be leached out by the weather, and that attempts had been made to stop this by applying cementitious solution as an external layer to cement the fungicide in the wood. In practice the cementitious material in crevices of the tie expanded and cracked the tie open, exposing the untreated interior, and the presence of the material also enhanced development of decay because the tie interior was absolutely shut off from any ventilation. Another prior art practice described by Moore was the drilling of holes through the tie to provide passages into which additional fungicide could be injected from time to time. However, this method was apparently not successful because if the tie had already been treated with a cementing solution the wood fibers or pores were filled and could not absorb the fungicide. On the other hand, if the ties had not been treated with a cementing solution, the wood pores were open and the liquid fungicide either drained away or was dried out by the wind and sun. In his patent Moore proposes to better treat the tie with fungicide by drilling a relatively large opening or reservoir along the length of the tie, with additional vertical openings in communication with the central reservoir. The tie is then exteriorly treated with oil or other cementing solution, and the reservoir is filled with liquid fungicide and water. The openings are then sealed off. The process is expensive and time consuming and particularly is not adapted for in situ treatment of ties after a period of service.

U.S. Pat. No. 4,202,494 issued to Rumell on May 13, 1980 teaches the treatment of used railroad ties, but he requires that the tie be removed from its operative position for placement in a mold. There a thin layer of polypropylene is molded onto the exterior surfaces and within any rail or tie plate hardware mounting apertures.

Nothing in the known prior art teaches in situ fungicide treatment of worn or weathered wooden railroad ties which harbor pockets of decay fed by moisture traveling along cracks and splits in the wood grain, and into untreated areas of the tie exposed through spike kill and plate cut. Moore makes plain that previous attempts to douse the affected tie areas with fungicide did not work because it either drained away or was eventually leached out. Thus, at best such fungicide might reach existing decay sites, but was not present long enough to combat future or developing decay.

SUMMARY OF THE INVENTION

According to the present invention, a method of in situ treatment of a wooden railroad tie is provided which takes advantages of or capitalizes upon the peculiar conditions which promote the growth of decay fungi.

As previously indicated, a worn and weathered railroad tie is characterized by weather checking in the form of cracks or splits in the wood grain extending along the length of the tie and beneath the tie plate. These passageways to the tie plate interface collect and carry moisture to the interface, and particularly to a central portion or interface decay site located below the rail and spaced inwardly of the tie plate edge margins. This decay site rarely is completely dried and therefore promotes the growth of decay fungi.

Moisture also collects in portions of the spike holes damaged by spike kill, and in any cut away or eroded portions of the tie caused by plate cut.

Although one skilled in the art might suppose that in situ treatment of worn ties would be impractical because it had already been tried and discarded by the prior art, applicant perceived that the decay cavities and passages that needed to be treated were uniquely accessible through the very same weather checks, cuts and abraded tie areas that provided the moisture paths responsible for the decay in the first place. However, the obstacle was that the fungicide would be ineffective to stop any more than existing decay because it was susceptible to leaching, and it was also unlikely that the fungicide could be made to reach all decay sites without having much of it wastefully drain away before it could penetrate to such decay sites. On the other hand, if the fungicide was made sufficiently viscous so that it would not drain away or leach out, it would probably be incapable of travelling along all of the minute, constricted moisture paths to the decay sites.

The present in situ method comprises the steps of injecting a wood preservative preparation of generally paste-like consistency into one of the empty spike openings adjacent the rail web, and continuing such injection until the preparation begins to escape from beneath the tie plate. The injection is preferably made simultaneously through the unoccupied spike holes adjacent the rail webs on opposite sides of the rail. The paste-like preparation flows under pressure through the splits and weather checks in the tie to any decay pockets or recesses, and particularly to the interface decay site between the tie and the tie plate, and to tie areas affected by spike kill and plate cut. The paste-like flow forms banks or reservoirs of the preparation in the decay pockets.

Although such a paste cannot pass through all of the many minute passages to decay areas because of its consistency, it has been found that the paste-like preparation can be formulated so that this goal is achieved over a period of time. More particularly, the preparation is formulated to include a water soluble fungicide such as crystals of sodium fluoride. This has been found to provide a surprisingly effective mechanism for the fungicide to migrate from the paste-like parent or carrier material to the areas of existing or potential decay. The water soluble character of the fungicide enables it to migrate over a period of time by osmotic action or otherwise, along the very same avenues of moisture which promote the decay in the target areas. In other words, the moisture promoting the decay is the vehicle by which the fungicide is enabled to travel to moist areas to kill decay fungi where it has or is likely to develop. The pasty parent preservative preparation tends to resist flow and thus provides tiny reservoirs from which the water soluble fungicide can travel along existing or subsequently developed paths of moisture to potential areas of decay, killing the decay and sterilizing the wood cell structure.

Other aspects and advantages of the present invention will become apparent from the following more detailed description taken in conjunction with the accompanying drawings.

BRIEF DESCRIPTION OF THE DRAWINGS

FIG. 5 is an enlarged view taken along the line 5—5 of FIG. 4;

FIG. 6 is a view taken along the line 6—6 of FIG. 5;

FIG. 7 is an enlarged cross sectional view of a spike and portions of a rail web, tie plate and tie;

FIG. 8 is a view similar to FIG. 7, but illustrating an unoccupied spike hole into which a wood preservative preparation as been injected;

FIG. 9 is a partial top plan view of a weathered railroad tie, illustrating the elongated grain oriented splits and cracks extending along the length of the tie, and also illustrating the interface decay site which characteristically forms in the illustrated configuration; and FIG. 10 is a view taken along the line 10—10 of FIG. 9.

DESCRIPTION OF THE PREFERRED EMBODIMENT

Figure 1:
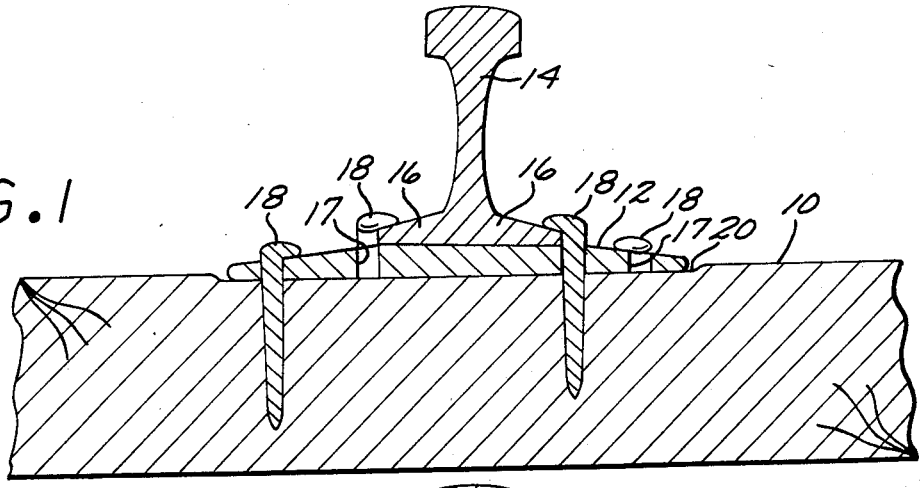
FIG. 1 is a view taken along the line 1—1 of FIG. 3.
Figure 2:
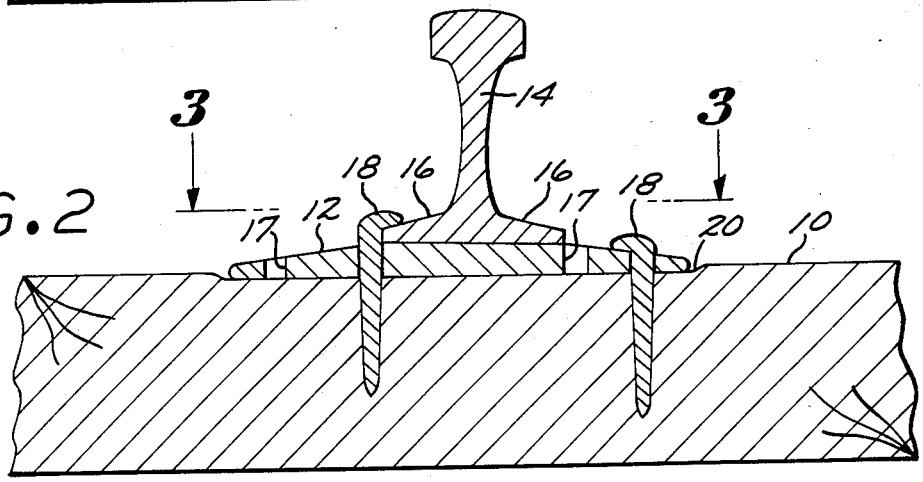
FIG. 2 is a view taken along the line 2—2 of FIG. 3.
Figure 3:
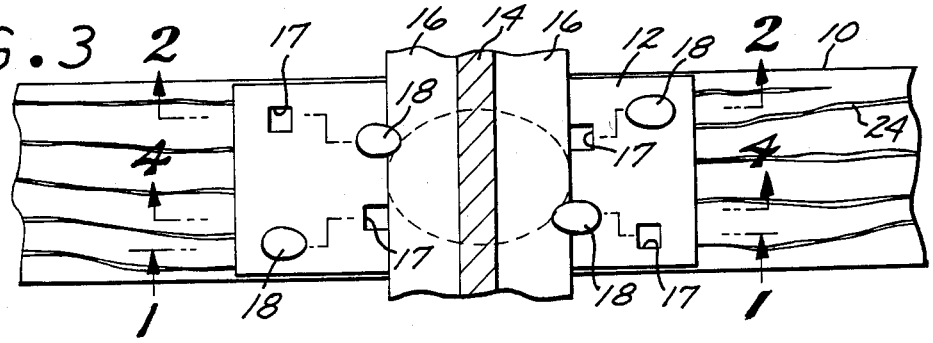
FIG. 3 is a view taken along the line 3—3 of FIG. 2.
Figure 4:
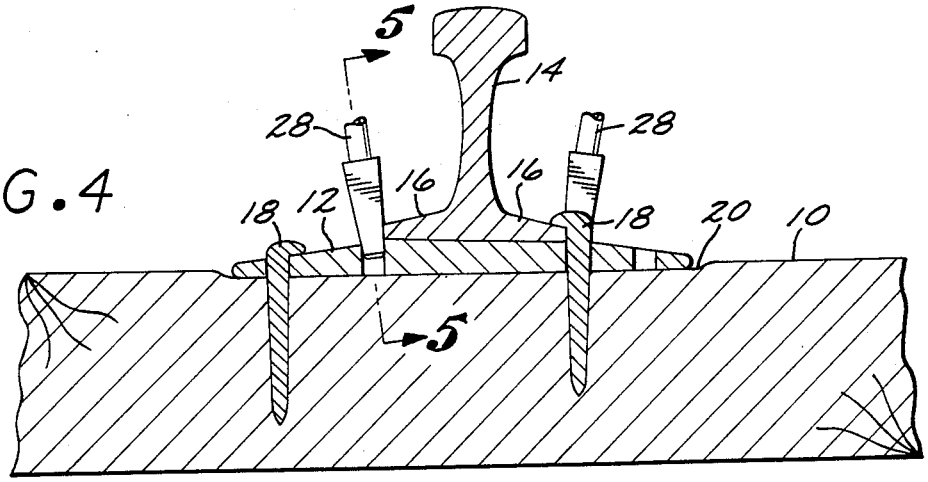
FIG. 4 is a view taken along the line 4—4 of FIG. 3.

Referring now to the drawings and particularly to FIGS. 1-3, a portion of a typical wooden railroad tie 10 is illustrated supporting a generally rectangular metal tie plate 12 and a steel rail 14 having a base defined by a pair of oppositely laterally extending webs 16 which rest upon the tie plate 12.

The usual tie plate 12 includes eight square spike holes 17, two of which are located on one side of the rail immediately adjacent the web 16, with another pair of spike holes 17 located in corresponding positions on the other side of the rail immediately adjacent the opposite rail web 16. Additional pairs of holes 17 are located laterally outwardly of the rail 14 adjacent the lateral edge margins of the tie plate 12. Conventional practice is to drive spikes 18 through two diagonally opposite ones of the spike holes 17 adjacent the rail 14, and to drive two additional spikes 18 into the diagonally oppositely located ones of the outer spike holes 17.

The empty or unoccupied spike holes are available for use in the event that the originally placed spikes 18 become loosened through spike kill. In that event, additional spikes would be driven into the originally unoccupied spike holes.

The spikes 18 extend into the interior of the wooden tie and after prolonged service use enlarge the associated spike holes through cylical train loadings so that paths for moisture are provided down into the spike holes and into the untreated interior of the tie, as seen in FIG. 7. Prolonged service use typically results in plate cut, which is best illustrated in FIGS. 1 and 2, as an eroded or depressed area 20 terminating adjacent the edge margins of the tie plate 12.

It is a phenomenon of the illustrated structure that moisture paths almost immediately develop which produce an interface decay site, generally designated by the numeral 22 in FIG. 9, located beneath the rail 14 and within the central portion of the interface between the tie plate 12 and the tie 10. After prolonged use, weather checking causes splits and cracks to form which define channels 24, as seen in FIG. 9, which extend in the direction of the wood grain of the tie. Such channels promote the passage of moisture to the decay site 22 and to the complete interface 26 defined between the tie and the tie plate. Since the interface 26 is in communication with the underlying depressed area 20 and with the spike holes occupied by the spikes 18, water can also travel to these areas as well as to the interface.

The decay site 22 and other crevices, pockets and recesses of the tie define incubation areas which promote the growth of decay fungi as a consequence of the combination of moisture, the presence of exposed or untreated wood fiber, and the elevated temperatures which result from exposure to the sun. These decay sites occur when the creosote treatment of the tie loses its effectiveness, or is compromised by abrasion of the treated wood or destruction of the treated wood by spike kill and plate cut.

The method of the present invention enables the tie 10 to be treated in situ without removal of any of the spikes 18. It has been found that a fungicide wood preservative preparation can be injected through one or more of the unoccupied spike holes 17 and into the interface 26 in sufficient quantity to spread across the interface into any decay pockets and recesses, and also into tie crevices and enlarged spike holes. This is done by employing an injection means having an injector element 28 characterized by an elongated nozzle 30 having an apertured tip which is square in transverse cross-section to fit within an empty or unoccupied spike hole 17, as seen in FIGS. 5 and 6.

The wood preservation preparation, seen at 32 in FIG. 8, is preferably of a paste-like consistency which resists flow under ambient conditions of tie use in the absence of pressure. Such a formulation enables the preparation 32, under an injection pressure of approximately 20 to 40 pounds per square inch, to flow from the spike hole 17 to the decay sites, as indicated by the arrows in FIG. 5. The preparation 32 flows to these sites and because of its viscosity tends to be retained and stored within any pockets and recesses at the sites.

The parent or carrier portion of the preparation 32 is preferably a coal tar base, which incorporates a water soluble active agent or fungicide. A thirty percent sodium fluoride material in crystal form has been found to work effectively as the active agent. The crystalline form of the fungicide is abrasive to pump injection equipment and consequently the components of the injection equipment should be selected accordingly. Although the equipment can be hand operated in the manner of an automotive grease gun, it is preferably a hydraulically operated pumping system which can be operated to discharge a predetermined amount of the material.

The nozzle 30 of the injector element 28 is preferably made of a suitable elastomeric material so that it can be pressed against the margins of the unoccupied spike holes 17 to provide a seal enabling the development of sufficient pressure to drive the preservative preparation to the decay sites.

Although injection of the preparation 32 can be made in the empty spike holes in sequential order, it has been found that a surprising increase in the amount of material which can be injected is obtained by simultaneous injection of the preparation 32 into the two unoccupied spike holes located immediately adjacent the opposite rail webs 16. This is done using two separately operated injector element 28. The operators preferably adjust the amount and rate of flow of injected material from their respective injector elements 28 so that the material injected by each begins to escape or break out from the interface 26 at the same time. Should one operator note that the material injected by him is beginning to escape or break out, he terminates further injection until the material injected by his partner in the opposite spike hole also begins to break out. Simultaneous break out results in a maximum amount of material injected which, with the illustrated arrangement, should be approximately eight to nine cubic inches for each tie plate 12. Approximately one cubic inch is disposed in the interface 26, another cubic inch is wasted, and the remainder fills cracks, crevices, recesses and the like in the tie.

Upon disengaging the injector elements 28 from the interiorly located spike holes, the injection procedure is repeated for the laterally outwardly located empty spike holes adjacent the side margins of the tie plate 12. Once this is completed, disengagement of the injector elements 28 relieves the pressure on the preservative and conditions are conducive to migration of the fungicide portion of the preparation 32 along moisture paths in the tie. Because of the water soluble nature of the fungicide, it is able to pass by osmostic-like migration through the same minute crevices and passages through which moisture has passed, thereby strategically locating the fungicide in position to kill any existing decay fungi and to sterilize the wood cell structure against future decay.

The relative immobility of the paste-like carrier portion of the preservative at decay sites, together with the ability of the water soluble fungicide to migrate along moisture paths, provides a combination which is surprisingly effective to greatly slow or prevent decay and structural damage of ties, and thereby promote extension of the service life of railroad ties.

Various modifications and changes may be made with regard to the foregoing detailed description without departing from the spirit of the invention.

We claim:

1. A method of in situ treatment of the interface between a wooden railroad tie and a rail supporting tie plate of the type having spike holes adjacent the rail in communication with said interface, with certain of the holes being unoccupied while others receive spikes which extend into the tie, said method comprising the steps of:

engaging an injector element of injector means in sealing relation with the edge margins of one of the unoccupied spike holes;

operating said injector means to inject under pressure a wood preservative preparation of generally paste-like consistency into said one of the unoccupied empty spike holes until said preparation begins to escape from said interface, said preparation including a water soluble fungicide;

disengaging said injector element to relieve the pressure upon said preparation; and allowing a period of time for said fungicide to migrate along any moisture paths in the railroad tie for penetrating the wood cell structure adjacent said paths.

2. A method according to claim 1 wherein said fungicide is sodium fluoride.

3. A method according to claim 1 wherein a first pair of the unoccupied empty spike holes are located immediately adjacent the opposite webs of the rail, and a second pair of the unoccupied spike holes are located farther from the rail and adjacent the tie plate lateral edge margins, and said engaging, operating and disengaging steps are performed upon both of said first pair, and then performed upon both of said second pair of holes.

4. A method of in situ treatment of the interface between a wooden railroad tie and a rail supporting tie plate of the type having spike holes adjacent the rail in communication with said interface, with a pair of the holes being unoccupied and located immediately adjacent the opposite webs of the rail, while others of the holes receive spikes which extend into the tie, said method comprising the steps of:

engaging a pair of injector elements of injector means in sealing relation with the edge margins of the pair of unoccupied spike holes, respectively;

operating said injector means to inject simultaneously under pressure into said pair of holes a wood preservative preparation, of generally paste-like consistency and tending not to flow in an unpressurized state at ambient conditions, until said preparation begins to escape from said interface, and adjusting the simultaneous injection of said preparation into said pair of holes so that the respective portions of the preparation injected into said pair of holes begin to escape from said interface at approximately the same time, said preparation including a water soluble fungicide;

disengaging said pair of injector elements to relieve the pressure upon said preparation; and allowing a period of time for said fungicide to migrate along any moisture paths in the railroad tie for penetrating the wood cell structure adjacent said paths.

5. A method according to claim 4 wherein said fungicide is sodium fluoride.

6. A method of in situ treatment of the interface between a wooden railroad tie and a rail supporting tie plate of the type having spike holes located adjacent the rail in communication with said interface, with a pair of the holes being unoccupied first holes located immediately adjacent the opposite webs of said rail, another pair of the holes being unoccupied second holes located adjacent the lateral edge margins of said tie plate, and others of the holes receiving spikes which extend into the tie, said method comprising the steps of:

engaging a pair of injector elements of injector means in sealing relation with the edge margins of said first holes, respectively;

operating said injector means to inject simultaneously under pressure into said first holes a wood preservative preparation, of generally paste-like consistency and tending not to flow in an unpressurized state at ambient conditions, until said preparation begins to escape from said interface, and adjusting the simultaneous injection of said preparation into said first holes so that the respective portions of the preparation injected into said first holes begin to escape from said interface at approximately the same time, said preparation including a water soluble fungicide;

disengaging said pair of injector elements to relieve the pressure upon said preparation;

engaging an injector element of injector means in sealing relation with the edge margins of one of said second holes;

operating said injector means to inject under pressure said preparation into said one of said second holes until said preparation begins to escape from said interface;

disengaging said injector element to relieve the pressure upon said preparation;

engaging an injector element of injector means in sealing relation with the edge margins of the other of said second holes;

operating said injector means to inject under pressure said preparation into said other of said second holes until said preparation begins to escape from said interface;

disengaging said injector element to relieve the pressure upon said preparation; and allowing a period of time for said fungicide to migrate along any moisture paths in the railroad tie for penetrating the wood cell structure adjacent said paths.

7. A method according to claim 6 wherein said active agent is sodium fluoride.

8. A method of in situ treatment of the interface between a wooden railroad tie and a rail supporting tie plate of the type having spike holes adjacent the rail in communication with said interface, with certain of the holes being unoccupied while others of the holes receive spikes which extend into the tie, said method comprising the steps of:

formulating a wood preservative preparation of generally paste-like consistency tending to resist flow in an unpressurized state at ambient conditions, and including a water soluble fungicide;

engaging an injector element of injector means in sealing relation with the edge margins of one of the unoccupied holes;

operating said injector means to inject under pressure said preparation into said one of the unoccupied holes until said preparation begins to escape from said interface;

disengaging said element to relieve the pressure upon said preparation; and allowing a period of time for said fungicide to migrate along any moisture paths in the railroad tie for penetrating the wood cell structure adjacent said paths.

* * * * *